United States Patent [19]

Cassels-Brown

[11] 4,423,659

[45] Jan. 3, 1984

[54] PAGE TURNER FOR SHEET MUSIC

[76] Inventor: Alastair K. Cassels-Brown, 13 Saint John's Rd., Cambridge, Mass. 02138

[21] Appl. No.: 311,917

[22] Filed: Oct. 16, 1981

[51] Int. Cl.[3] ..... G10G 7/00

[52] U.S. Cl. ..... 84/486; 84/508; 84/511

[58] Field of Search ..... 84/486–521

[56] References Cited

U.S. PATENT DOCUMENTS 311,950 2/1885 Branig ..... 84/486

344,861 7/1886 Richards ..... 84/486

*Primary Examiner*—Lawrence R. Franklin

*Attorney, Agent, or Firm*—Donald N. Halgren

[57] ABSTRACT

A portable page-turning device having a plurality of rotatable drums, each drum having a filament wound therearound, each filament being attachable to a successive page to be turned, for turning, upon a proper signal, successive pages. The rotatable drums are biased and hold the filaments in tension up to a notch in a face plate. The filaments are loosely disposed from the faceplate to the pages to be turned to which they are attached. In the preferred embodiments a movable disengagement lever may trace out an angular path to allow the filaments to be serially released from the notches and provide a tension on the entire filament, turning any page thereattached.

10 Claims, 5 Drawing Figures

PAGE TURNER FOR SHEET MUSIC

BACKGROUND OF THE INVENTION (1) Field of the Invention

This invention relates to page-turning mechanisms and more particularly to mechanisms for turning pages of sheet music or the like.

(2) Prior Art

During the playing of musical instruments, it is often necessary to turn at least several pages of sheet music. Even while playing extended works such as a piano sonata, a limited number of pages need to be turned. However, they should be turned, quickly, quietly and unobtrusively upon a proper signal and without interrupting the musician's playing of his instrument. A number of devices have been disclosed in the art, which however do not meet these requirements. U.S. Pat. No. 2,484,106 to Mallina discloses a page turner where a motorized winding means has a thread of substantial length attached to successive pages of a text. This device is somewhat complicated by the utilization of clutch arragements and electric motors or the like. U.S. Pat. No. 3,665,093 issued to Machnacz shows a page turner having an electric motor secured to a pulley and endless belt arrangement, wherein a swivel clip is guided therealong upon activation by a foot operated switch.

Other page-turning devices are shown in U.S. Pat. Nos. 837,833 to Hennequin; 917,782 to MacDonald; 995,959 to Gowdey; and 1,367,101 to Shibamura. They are all rather cumbersome mechanisms which are also somewhat complicated.

It is an object of this invention to provide a page-turning mechanism which overcomes the disadvantages of the prior art.

It is a further object of this invention to provide a page-turning mechanism which is fast and quiet in operation as well as portable and unobtrusive in appearance and function.

It is yet a further object of this invention to provide a page-turning mechanism which will not require electric motors or batteries and which may turn an appropriate number of pages without the need for resetting.

It is yet a still further object of this invention to provide a page-turning mechanism which may be arranged to preferably turn pages from the left side or turn pages from either side, and which mechanism stays attached to the particular pages after they have been turned, to permit ease of resetting the mechanism with minimum time consumed thereby.

BRIEF SUMMARY OF THE INVENTION

A page-turning mechanism in its preferred embodiment comprises a filament tensioning means, a filament holding means and a filament releasing means, arranged with a plurality of filaments which are respectively secured at their trailing ends, to a plurality of pages of reading material. Each filament tensioning means may preferrably comprise a biased sheave mounted on a base member. The sheave may be biased by a coil spring secured between a fixed axis of the sheave and an outer portion of the sheave, to provide tension on any filament oppositely wound therearound and held securely at a filament holding means which itself comprises a faceplate attached to the base member. The faceplate has a plurality of openings through which each respective filament extends. In the preferred embodiment, each opening may be somewhat elongated, one transverse dimension at the end of the elongated openings being larger than the other end and slightly asymmetrical with respect to the slot.

The filament releasing means preferably comprises a biasable lever pivotably disposed on the base member between the filament tensioning means and the filament holding means. The biasable lever comprises a pair of arms angularly arranged in a fixed manner with respect to one another. The arms are pivotally supported at their connected ends on an axis in a housing. The arms have a tension spring arranged between one of the arms and an extension of the housing to provide a constant bias between the arms and the housing. The biasable lever has a spring arrangement between the housing and the base member to effectuate an arcuate return sweep of the arms after the biasable lever has been actuated and released a filament. The distal end of the upwardmost arm has a control filamet attached thereto. The control filament is arranged through a Bowden cable and is connected at its other end to a control filament tensioning pedal, arranged at some convenient location for actuation by the page-turning mechanism operator. The distal end of the lowermost arm has an angled stepped extension disposed thereon. The stepped extension is arranged so as to be able to move adjacent a tensioned filament and slide it in its elongated opening towards its enlarged portion from its narrow end.

Each respective filament is held in tension between the biased sheave and a stop element in the filament disposed on the distal side of the face-plate, each filament continuable to and attached to a respective page of material to be turned.

Upon tensioning of the control filament, the pair of arms are first pivoted about their axis and then upwardly away from the base of the housing to effectuate a swing of the lowermost arm from the base member and to cause the stepped extension thereon to catch a first tensioned filament and slide it along the elongated slot towards its other end having the enlarged opening. Once the tensioned filament reaches the enlarged opening, the stop element in the filament is allowed to be pulled therethrough under action of the biased sheave. This also pulls over the page attached to the other end of the filament. The spring between the arm and the housing biases the pair of arms towards the base member again, and the spring between the housing and the base member causes the pair of arms to swing back to its initial position to await a further tensioning of the control filament, which provides a moment generated in the uppermost arm, to effectuate the swinging of the arms towards a subsequent filament awaiting release in the narrow end of a subsequent elongated opening.

Alternative embodiments include a threaded shaft biasedly journalled in a frame. A control filament is disposed from an actuator pedal or the like, which filament extends into the frame and around the shaft. A nut is disposed on the threaded shaft and has an arm secured on one side thereof. The frame has a faceplate, as in the aforementioned embodiment, with the filaments extending therethrough, held by stop means in the slots, and attached to biased sheaves as in the aforementioned embodiment, or to elastic filaments, which are secured, at their other end to a portion of the frame. As the control filament is pulled, it rotates the threaded shaft which, due to friction therebetween, also rotates the nut, until the arm thereattached, swings into contact with the first filament in a slot, whereupon the nut stops rotating while the shaft remains rotating, causing the nut and arm to move axially along the shaft, lifting the stop means of the filament into the wide portion of the slot, permitting the stop means to be released, pulling the tensioned filament attached to the page through the slot, thus turning the page. The actuator pedal may then be released and the biased means on the threaded shaft then causes the shaft to rotate in the opposite direction to rewind the control filament, and return the arm to its beginning position to await a subsequent signal.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENT

Figure 1:
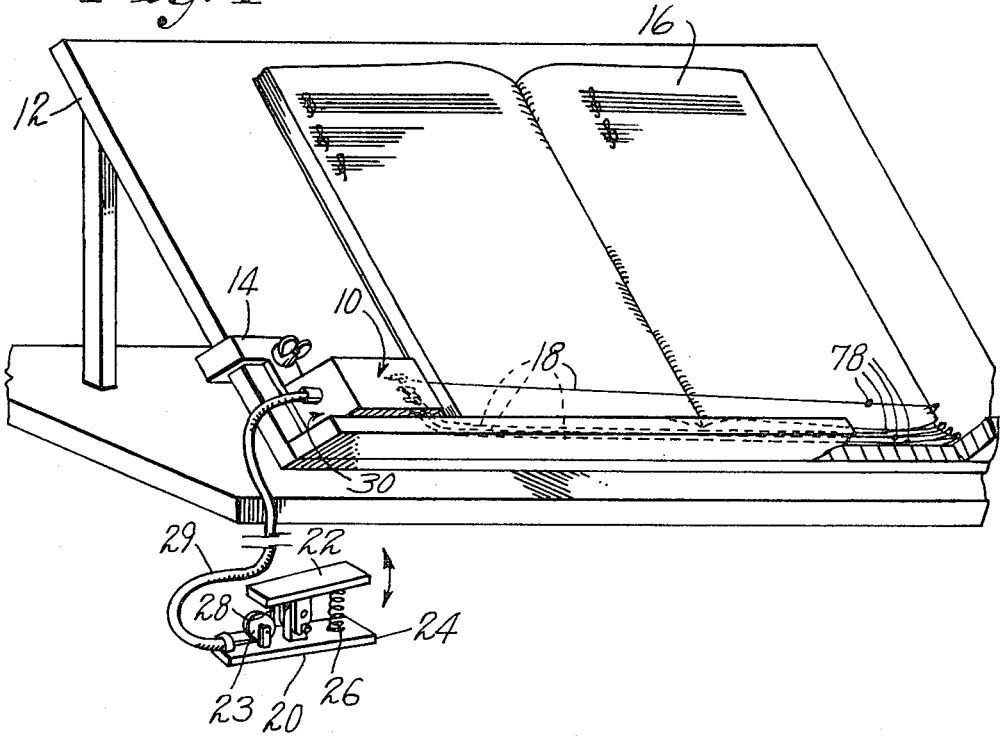
FIG. 1 is a general perspective view of the present invention, set up with a text having pages to be turned.

Referring now to the drawings in detail, and particularly to FIG. 1, there is shown a page-turning mechanism 10 securely arranged on a support 12 by a clamp 14 or the like. A plurality of pages 16 to be turned are also resting on the support 12 with a plurality of filaments 18 extending from the page-turning mechanism 10, one filament 18 attached by a clip or the like to each successive page 16 to be turned. A pedal or manually operable actuation switch 20 may be arranged beneath the support 12, in any location which may be convenient to an operator of the page-turning mechanism 10. The switch 20 comprises a pedal 22 which is pivotally attached to a base 24. A spring 26 is disposed between the pedal 22 and the base 24 to bias the pedal away from contact with the base 24. A control filament 28 as part of a Bowden cable 29 extends from the distal edge of the pedal 22, as shown in FIG. 1, around a pulley 23 to the page-turning mechanism 10 through an orifice in a first side wall of an enclosure 30 surrounding the inner mechanism, only a base 32 and a second side wall 34 of the enclosure 30 being shown in FIG. 2 with the preferred embodiment of the inner mechanism.

Figure 2:
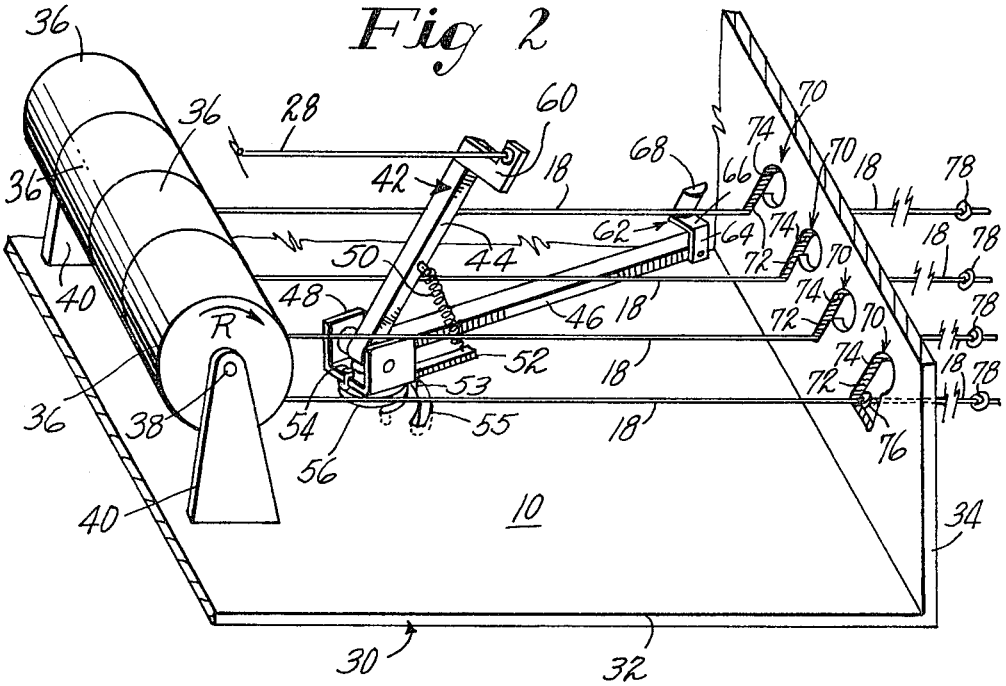
FIG. 2 is a perspective view of the preferred embodiment of a page-turning mechanism.

A plurality of individually biased sheaves 36, only four being shown in this embodiment, are journalled about an axis 38 to ratate about the axis 38 in a direction R shown by an arrow in FIG. 2. The axis 38 is attached to a frame 40 which is secured to the base 32 of the enclosure 30. Each sheave 36 may be biased by a coil spring or elastic member therewithin, not shown, arranged about the axis 38. Alternatively, the sheaves 36 may be biased by a weight, not shown, attached to a line secured to each sheave 36, to provide the rotary power thereto.

A sequential release mechanism 42 is shown in FIG. 2, comprising an upper arm 44 fixedly arranged at an angle with respect to a lower arm 46. The upper and lower arms 44 and 46 together are pivotally journalled at their intersection to a housing 48. A spring 50 is disposed between the upper arm 44 and an extension 52 arranged on the base of the housing 48. The housing 48 is mounted on a swivel 54 secured to the base 32. A housing biasing member 56, weaker than spring 50, is disposed between the housing 48 and the base 32 sufficient to effect a pivoting return motion in the upper and lower arms 44 and 46 about the swivel 54 upon release of a filament thereby. The housing biasing member 56 may be comprised of an elastic band, a coil spring or the like. A pin 53 extending from extension 52 may track in a groove 55 in the base 32 to govern the pivot of the mechanism 42.

The control filament 28 is attached to an extension 60 on the side of the distal end of the upper arm 44. A stepped extension 62 is attached to the distal end of the lower arm 46. The stepped extension 62 may comprise a first generally slanted portion 64, a generally horizontally arranged second portion 66, attached to the distal end of the first portion 64, and a third generally slanted disposed portion 68 acutely arranged with respect to and attached to the distal end of the second portion 66.

A plurality of shaped openings 70, one for each filament 18, may be disposed in the second side wall 34, spaced apart from one another and evenly spaced from the base 32. Each opening 70, preferably comprises a lower narrow slot 72, slanted from the vertical and being generally parallel to the slanted portion 68 and widening upwardly to a generally circular opening 74. The lower narrow slot 72 is of a dimension sufficient to prevent a first stop means 76 or like movement retarder such as a knot or bead arranged in each filament 18 from therepassing. The generally circular openings 74 at the other end of the opening 70 are of a dimension sufficient to prevent a second stop means 78 or movement retarder arranged in each filament 18, and spaced from each first stop means, from passing therethrough.

Each filament to a respective sheave 36 and is disposed around the sequential release mechanism 42, and each extends through the opening 70 in the second side wall 34. The distal end of each filament 18 is attached by a clip or the like, to the corner of successive pages 16 to be turned, as shown in FIG. 1. Alternatively, the sheaves 36 may be replaced by an elastic filament which extends from the first stop means 76 into the enclosure 30, arranged to have sufficient pulling capacity and length, to pull the filament 18 enough to have the second stop means 78 reach the opening 70.

Operation of the preferred embodiment of the page-turning mechanism 10 occurs when an operator depresses the pedal 22 towards the base 24 of the switch 20, shown in FIG. 1. The movement of the pedal 22 pulls the control filament 28 comprising the inner portion of the Bowden cable 29, and which control filament 28 is attached at its other end to the extension 60 of the disengagement mechanism 42, to effect an upward arcuate movement of the upper and lower arms 44 and 46 after rotating about the swivel 54 in a vertical plane with respect to the base 32 which, for the present description will be representing a horizontal plane. The stepped extension 62 is slightly biased by the housing biasing member 56 counter-clockwise, as seen from above, against the pull of the control filament 28, to return the lower arm 46 to its original location. The upward movement also caused by the pull of the control filament 28 on the upper arm 44 causes the second portion 66 of the stepped extension 62 to lift the filament 18 up the slanted lower narrow slot 72 into the circular opening 74, whereupon the first stop means 76 is pulled therethrough, because of the filament 18 being under tension awaiting disengagement and subsequent winding on its respective biased sheave 36. The filament 18 winds up around the sheave 36 as the sheave 36 rotates in the direction R until the second stop means 78 or buffer, which is larger than the first stop means 76, reaches and is impeded against further movement at the opening 70. The filament 18 during its movement through the opening 70 between the first stop means 76 and second stop means or buffer 78, pulls the page and effects the turning thereof.

During the movement of the disengaged filament 18 from the first stop means 76 to the second stop means 78, the upper and lower arms 44 and 46 are pulled back towards the base 32 by action of the stronger spring 50 arranged between the upper arm 44 and the extension 52 on the housing 48. Then the release mechanism 42 is caused to sweep arcuately in the horizontal plane by interaction of the weaker house biasing member 56 arranged between the base 32 and the housing 48 to return to its starting position to await a subsequent tensioning of the filament 28 which will cause the release mechanism 42 to again swing horizontally and then upwardly along the path of a slot 72 when the third portion 68 on the stepped extension 62 strikes the next filament 18 disposed in the next narrow lower slot 72, and which sequence may yet again be reinitiated by a subsequent depression of the pedal 22 to effect the tensioning of the control filament 28.

Figure 3:
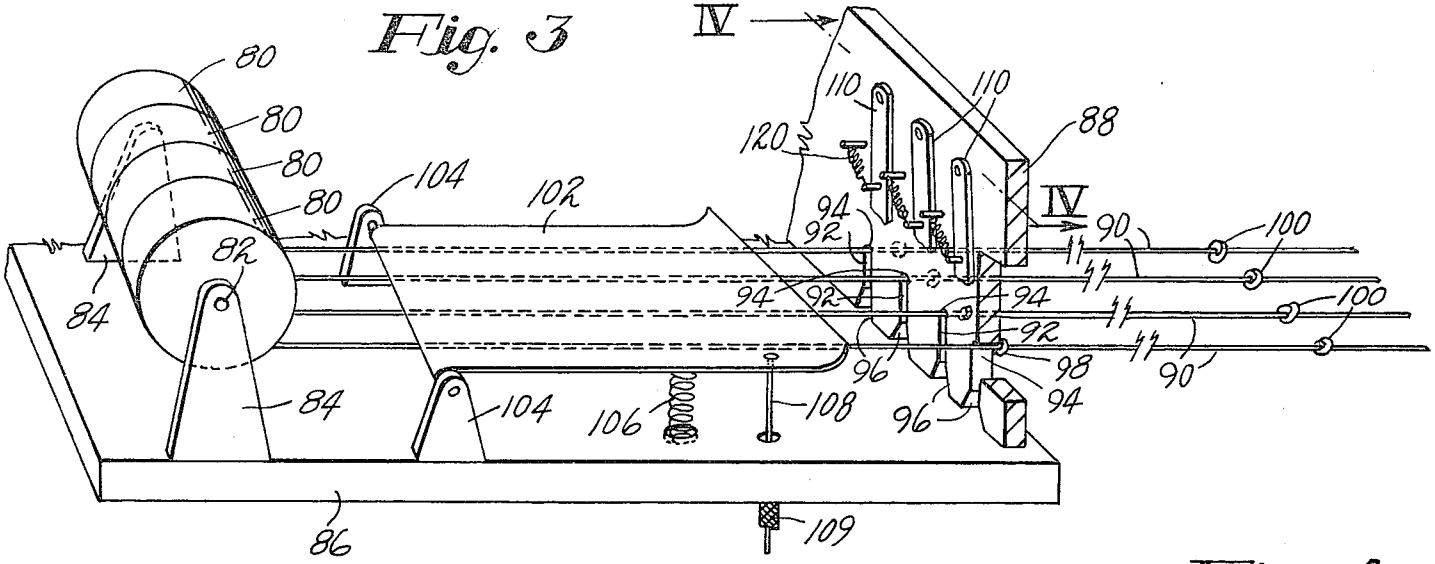
FIG. 3 is a partial perspective view of an alternative embodiment of a page-turning mechanism.
Figure 4:
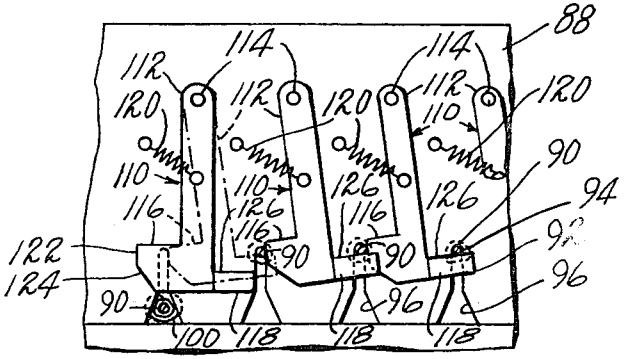
FIG. 4 is a view taken along the lines IV—IV of FIG. 3.

An alternative embodiment is shown in FIGS. 3 and 4, wherein a similar array of biased sheaves 80 are journalled on an axis 82 mounted in a frame 84 and secured on one end of a base 86. A face plate 88 is arranged on the other end of the base 86. A plurality of filaments 90 are attached each at one end to one of the biased sheaves 80, and at their other ends to pages to be turned by clips or the like, as in the aforementioned embodiment. The face plate 88 has slot 92 for each filament 90. Each slot 92 has a narrow top 94 and a wider opening 96 towards the base 86. The filaments 90 have a first stop means 98 or movement retarder such as a knot or bead or the like therein, and a second stop means 100 or movement retarder spaced therefrom as in the aforementioned embodiment. A rigid generally planar depressor plate 102 is pivotably arranged in a pair of bearing supports 104 and may be biased away therefrom by a compression spring 106 or the like, disposed between the base 86 and the plate 102. The filaments 90 extend between the plate 102 and the base 86. A control filament 108 may extend as the inner portion of a Bowden cable 109, from the distal side of the depressor plate 102 to a pedal as shown in the earlier embodiment.

An escapement lever 110 arranged on the inner side of the face plate 88, has an elongated shank 112 which extends downwardly from a pivot bearing 114, as shown in FIG. 4, adjacent each slot 92, and has a first extension 116 and a stepped second extension 118 disposed off of opposite sides of the lower end of the shank 112. Each escapement lever 110 has a spring 120 arranged between the shank 112 and the face plate 88 to effect a clockwise bias around the pivot bearings 114, as shown in FIG. 4. Each first extension 116 has a generally vertically arranged first planar face 122 on its distal end which presses against a respective filament 90 in the narrow top portion 94 of each slot 92. A second planar face 124 is slanted acutely with respect to the first planar face 122. Each second extension 118 steps outwardly away from the face plate 88 and avoids contact with an adjacent first extension 116 of an adjacent escapement lever 110. The second extension 118 has an upper surface 126 which slips under the adjacent filament 90 to keep it from falling into the wide portion 96 of its slot 92.

Operation of the second embodiment shown in FIGS. 3 and 4 occurs when the control filament 108 is pulled, as may be done in the aforementioned embodiment, to effect a downward pivoting of the depressor plate 102 about its pivot bearings 104, to effect a downward force on the filaments 90, only the leftwardmost one slipping into the wide opening 96, as shown in FIG. 4, because the remaining filaments 90, athough pressed downwardly by the depressor plate 102, are prevented from so doing by interference with the obstructing upper surface 126 of each of the remaining unpivoted stepped second extensions 118. Once the filament 90 has dropped into the wide opening 96 of its respective slot 92, it is caused to wind up about the biased sheave 80 as described in the aforementioned embodiment and pull the page thereattached. The escapement lever 110 is then pivoted about its pivot bearing 114 by action of the spring 120 pulling the next obstructing upper surface 126 of the second extension 118 out from under the subsequent filament 90. Each subsequent filament 90 is thus caused to turn the respective pages to which they are attached, by being pulled along the length between their first and second stop means 98 and 100. The spring 106 causes the depressor plate 102 to be biased upwardly from the base 86. Another embodiment may include the utilization of an elasticized portion of filament to replace the biased sheaves 80, wherein a sufficient length of elastic filament pulls the stop means 98 through the slot opening 96 until the second stop means 100 reaches the opening 96.

Figure 5:
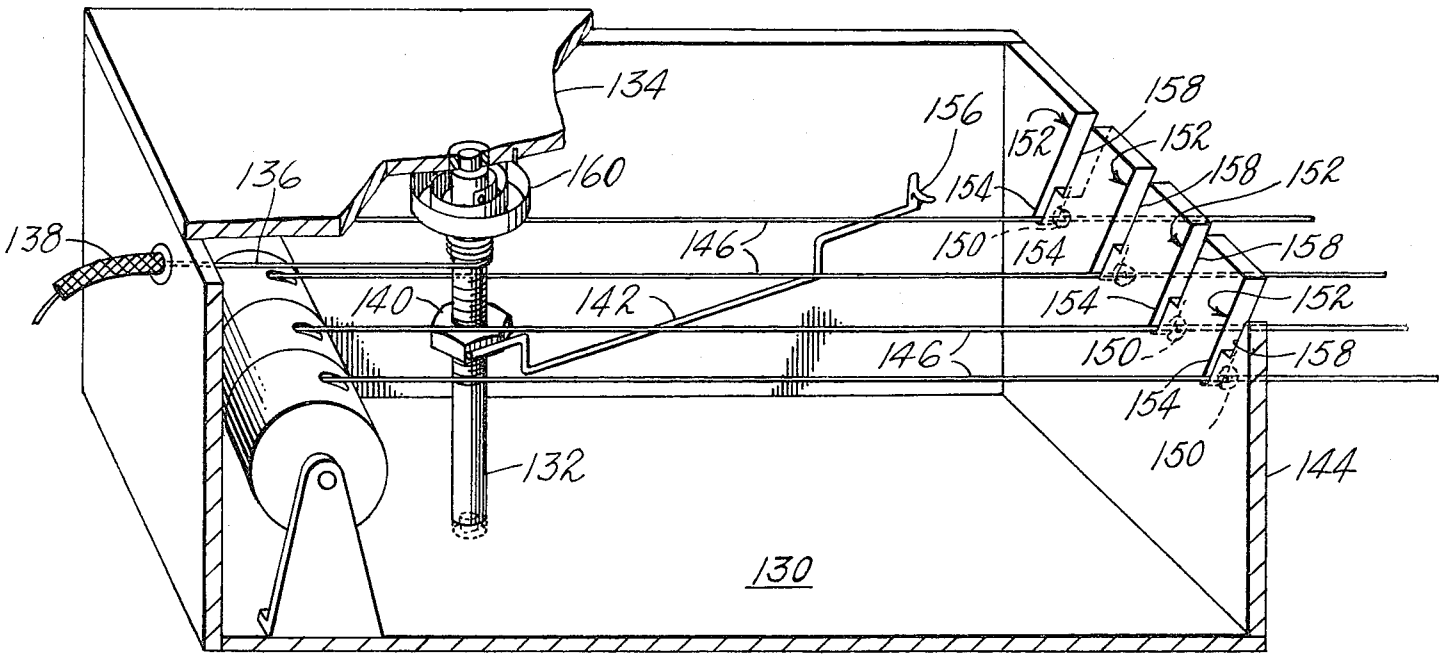
FIG. 5 is a perspective view of yet another alternative embodiment of the page-turning mechanism.

A further embodiment is shown in FIG. 5 wherein a release mechanism 130 includes a threaded shaft 132 which is journalled in a frame 134. A control filament 136 is disposed in a Bowden cable 138 and is attached to an actuator pedal as in the aforementioned embodiments. The filament 136 is wound around the shaft 132. A nut 140 is disposed on the shaft 132 and has an arm 142 secured to one side thereof. The frame 134 has a face plate 144, as in the aforementioned embodiment, with a plurality of page-turning filaments 146 biased at one end thereof in the frame 134 by any one of the aforementioned means, each filament 146 being clipped or attached to a page, in a manner similar to the earlier embodiments, and each having a first stop means 150 as earlier described. Each filament 146 extends through a generally vertically arranged slot 152 having a narrow portion 154 in which the unreleased filament 146 rests.

When the control filament 136 is tensioned, it causes the threaded shaft 132 to rotate in its journals. The arm 142 attached to the nut 140 has a "C" shaped finger 156 on its distal end which slips partially around a portion of an adjacent filament 146. As the shaft 132 turns, it causes the nut 140, secured against rotation by the arm 142 disposed against a filament 146, to move along the axis of the rotating shaft 132, pulling the filament 146 out of the narrow portion 154 of the slot 152, thus freeing the first stop means 150 therefrom, allowing it to pass through a wider portion 158 of the slot 152, pulling a page over, not shown, as in the aforementioned embodiment, until the filament 146 is stopped by a second stop means, not shown. When the actuator pedal, shown earlier, is released after the page is pulled, the threaded shaft 132 stops revolving in one direction. A biasing means 160, such as a spring or elastic, which is arranged between the shaft 132 and the frame 134, causes it to counter-rotate and causes the nut to be displaced to its original position on the shaft 132, because the arm 142 sweeps backwardly during counter-rotation until it strikes a rear wall, not shown, of the frame 134. The arm 142 is thus returned to its starting position to await a subsequent displacement caused by the filament 136 again being tensioned.

Thus there has been shown unique, portable, quiet, efficient means for turning a plurality of pages by an operator, who does not need to actuate either mechanism with his hands, and which mechanisms automatically advance to the subsequent means for turning subsequent pages.

I claim:

1. A mechanism for turning a plurality of successive pages of sheet music or the like, comprising:

a biased filament extending from a sheath, through an asymmetrical opening in a panel, and attached to a page to be turned, said asymmetrical opening in said panel comprising an opening having a narrow portion sufficient to prevent a stop means attached to each filament from going therethrough, and a wide portion sufficient to permit said stop means to go therethrough; and a release mechanism for moving said filament transversely with respect to said opening to permit said stop means to be pulled therethrough and said page thereattached to be turned.

2. A mechanism for turning a plurality of successive pages of sheet music or the like comprising:

a filament attachable to each of said pages to be turned, each filament having at least one stop means thereon;

an arrangement of biased sheaves journalled on an axis, each actuatable to pull one of said filaments to turn its respective page;

a movement retarding means for holding each of said filaments securely comprising a panel having an arrangement of openings therein, one for holding each filament, said openings each having a wide portion and a narrow portion, said one stop means being capable of passing through said wide portion but being unable to pass through said narrow portion; and a releasing mechanism for sequentially releasing successive filaments from said movement retarding means to permit said one stop means to pass through said wide portion and thereby permit said filament to turn its respective page.

3. A mechanism as recited in claim 2 wherein said biasing means comprises a filament of elastic material.

4. A mechanism as recited in claim 2 wherein said releasing mechanism includes a pivotable pedal which when actuated effects said subsequent successive filament movements.

5. A mechanism as recited in claim 4 wherein said filaments each have a second stop means thereon between said one stop means and the associated page, said second stop means being unable to pass through said wide portion, and said releasing mechanism comprises a generally planar biased depressable plate disposed over said filaments, and a biased lever for each filament holding said filaments in said narrow portion of each opening until movement of said plate causes a filament to be pushed into said wide portion of said opening permitting said xx one stop means to be pulled therethrough up to said second stop means, thus effecting the page-turning operation.

6. A mechanism as recited in claim 5, wherein said biased levers are held from pivoting by their being pressed against an adjacent filament.

7. A mechanism as recited in claim 6, wherein each of said levers pivot upon release of the filament it is pressing against in the narrow portion of the opening, thus pivoting an obstructing surface away from a subsequent filament awaiting the pulling through its respective opening.

8. A mechanism as recited in claim 2, wherein said releasing mechanism has at least one arm which is pivotable to displace a filament from a narrow portion of said opening to a wide portion of said opening to permit said one stop means to be pulled therethrough and said filament to be wound about said sheave, thus turning a page thereattached.

9. A mechanism as recited in claim 8, wherein said arm is biased so as to return to its initial location to await a subsequent rotation so as to engage a subsequent filament for impending release.

10. A mechanism as recited in claim 2, wherein said releasing mechanism also includes a rotatable thread shaft having a nut secured thereto, said arm being attached to said nut to engage said filaments, said shaft being rotated by a tensionable filament wound therearound.

* * * * *